US005174445A

United States Patent [19]

Mull

[11] Patent Number: 5,174,445

[45] Date of Patent: Dec. 29, 1992

[54] PAINT BRUSH STORAGE BAG ASSEMBLY

[76] Inventor: Robert L. Mull, 616 W. 7th St., Newton, N.C. 28658

[21] Appl. No.: 789,062

[22] Filed: Nov. 7, 1991

[51] Int. Cl.[5] ..... B65D 83/10

[52] U.S. Cl. ..... 206/361; 206/15.3; 383/120; 15/174; 15/175; 15/248.1

[58] Field of Search ..... 206/15.2, 15.3, 361, 206/813; 15/168, 174, 175, 185, 248 R; 220/603; 383/120

[56] References Cited

U.S. PATENT DOCUMENTS

| | | | |
|---|---|---|---|
| 74,224 | 2/1868 | Hergesheimer | 15/168 |
| 118,871 | 9/1871 | Minetree | 15/174 |
| 209,279 | 10/1878 | Marsden | 15/168 |
| 298,359 | 5/1884 | Elliott | 15/168 |
| 305,545 | 9/1884 | Sutton | 15/168 |
| 530,386 | 12/1894 | Beockh, Jr. | 15/168 |
| 1,498,302 | 6/1924 | Satake | 206/15.3 |
| 1,938,442 | 12/1933 | Stuart | 206/361 |
| 1,983,619 | 12/1934 | Lent | 206/15.3 |
| 2,070,448 | 2/1937 | Nork | 15/168 |
| 2,290,359 | 7/1942 | Ringler | 206/15.3 |
| 2,485,068 | 10/1949 | Santana | 206/361 |
| 2,533,829 | 12/1950 | Merryweather | 206/361 |
| 2,552,741 | 5/1951 | Schumann | 206/361 |
| 2,602,947 | 7/1952 | Soss | 15/168 |
| 2,932,423 | 4/1960 | Baumgartner | 220/603 |
| 2,989,767 | 6/1961 | Charvat | 15/168 |
| 3,000,491 | 9/1961 | McIntosh | 206/361 |
| 3,027,999 | 4/1962 | Heroy, Jr. | 206/361 |
| 3,690,448 | 9/1972 | Switzer | 206/361 |
| 4,152,805 | 5/1979 | Saldarriaga et al. | 15/175 |
| 4,388,996 | 6/1983 | Panicci | 220/603 |
| 4,682,691 | 7/1987 | Spiering | 206/813 |
| 4,967,903 | 11/1990 | Kettle et al. | 206/361 |
| 5,032,188 | 7/1991 | Kettle et al. | 206/361 |
| 5,040,902 | 8/1991 | Eaton et al. | 383/120 |
| 5,084,932 | 2/1992 | Zanchi | 15/168 |

FOREIGN PATENT DOCUMENTS

| | | | |
|---|---|---|---|
| 478680 | 11/1951 | Canada | 206/15.1 |

*Primary Examiner*—David T. Fidei
*Attorney, Agent, or Firm*—W. Thad Adams, III

[57] ABSTRACT

A paint brush storage bag assembly for storing a paint brush in a storage liquid between uses and holding the brush while in use. The assembly comprises a foil bag for receiving the bristles and the adjacent portion of the ferrule therein. The bag has a relatively flat bottom for supporting itself in an upright position and also has a pair of vertical pleats therein for permitting an upper edge of the bag to be closed around the ferrule of the brush. A paint brush is provided and includes a relatively wide elastic band positioned in a stretched condition around the ferrule of the brush. The elastic band is rollable onto itself to form a band of increased thickness to serve as a drip guard. The brush can also be suspended on the edge of the foil bag by the rolled-up elastic band. The elastic band is unrollable downwardly over the upper edge of the foil bag to secure the bristles of the brush in the bag and seal the contents of the bag therein.

9 Claims, 6 Drawing Sheets

FIG. 5
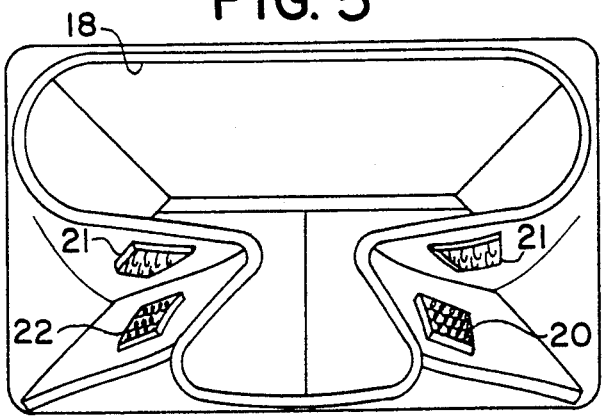
FIG. 6
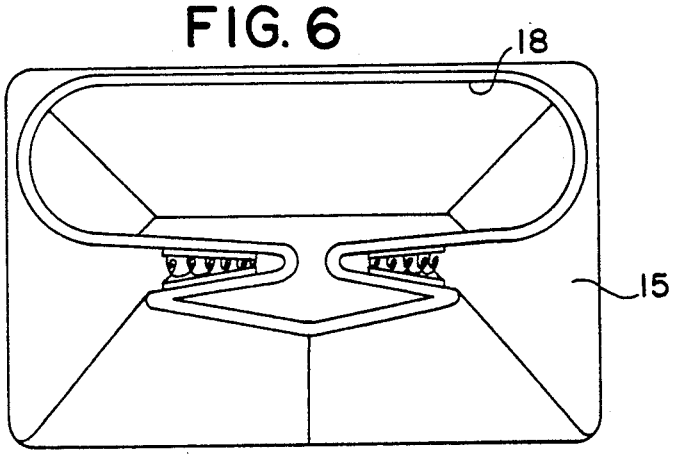
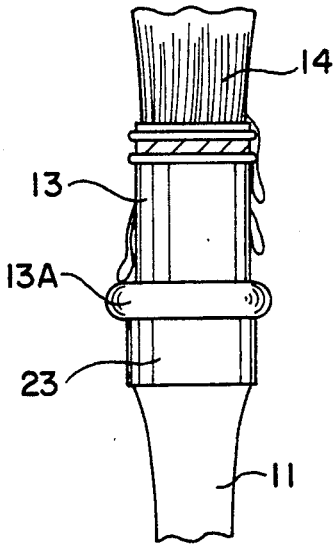
FIG. 8

PAINT BRUSH STORAGE BAG ASSEMBLY

TECHNICAL FIELD AND BACKGROUND OF THE INVENTION

This invention relates to a paint brush storage assembly for storing a paint brush between uses and during use, as described below. Ideally, paint brushes are carefully cleaned, shaped, dried and stored after each use. However, it is commonplace to merely place the brush in a jar of water or mineral spirits, depending on the type of paint, acrylic or oil-based, used on the brush. Very often it is necessary to store the brush for only a brief period of time. This makes the process of properly cleaning a brush very time consuming.

This invention relates to a storage bag which provides a quick and easy way of storing a brush for either a long or short period of time, as needed. The brush and storage bag can be sold separately or as a unit. The invention also includes a number of other features which make painting more efficient and neater. Brushes last longer because they do not dry out and are not stored with the weight of the brush on the bristles. The stored unit is much safer since the liquid is enclosed, and evaporation of volatile liquids is prevented.

SUMMARY OF THE INVENTION

Therefore, it is an object of the invention to provide a paint brush storage bag assembly for storing a paint brush between uses.

It is another object of the invention to provide a paint brush storage bag assembly which can be sold as a prepackaged unit.

It is another object of the invention to provide a paint brush storage assembly which can also serve as a brush support while the brush is in use.

It is another object of the invention to provide a paint brush which includes a drip guard.

It is another object of the invention to provide a paint brush which includes means for sealing the bristles of the brush in a storage bag containing a storage liquid.

It is another object of the invention to provide a paint brush storage bag assembly for storing a paint brush without the weight of the brush on the bristles.

These and other objects of the present invention are achieved in the preferred embodiments disclosed below by providing a paint brush storage bag assembly for storing a paint brush in a storage liquid between uses and holding the brush while in use. The assembly comprises a foil bag for receiving the bristles and the adjacent portion of the ferrule therein. The bag has a relatively flat bottom for supporting itself in an upright position and also has a pair of vertical pleats therein for permitting an upper edge of the bag to be closed around the ferrule of the brush. A paint brush is provided and includes a relatively wide elastic band positioned in a stretched condition around the ferrule of the brush. The elastic band is rollable onto itself to form a band of increased thickness to serve as a drip and run guard. The brush can also be suspended on the edge of the foil bag by the rolled-up elastic band. Finally, the brush 15 can be laid flat on a surface, and the drip guard 13A spaces the bristles 14 off of the surface to prevent contact between the bristles 14 and the surface. The elastic band is unrollable downwardly over the upper edge of the foil bag to secure the bristles of the brush in the bag and seal the contents of the bag therein.

According to one preferred embodiment of the invention, the invention includes fastening means for securing the pleats of the bag together around the ferrule of the brush.

According to another preferred embodiment of the invention, the fastening means comprises first and second complementary hook and loop fastener members secured in mating relation on opposite sides of the pleat.

Preferably, the elastic band comprises rubber.

Preferably, the elastic band is substantially the same width as the ferrule of the brush.

According to yet another preferred embodiment of the invention, a weight is provided in the bottom of the bag to retard the bag from tipping.

According to yet another preferred embodiment of the invention, the bag defines a front side, the front side being sloped to provide a surface for the brush to lean against when suspended by the rolled up elastic band on the top edge of the bag.

According to one preferred embodiment of the invention, hanging means are secured to the handle of the brush for hanging the brush for storage.

Preferably, the hanging means comprises one or the other of a hook and loop member for cooperating with a complementary hook and loop fastener member attached to a supporting surface on which the brush is to be stored.

According to one preferred embodiment of the invention, a paint brush is provided and includes a handle, a ferrule and bristles, and including a relatively wide elastic band positioned in a stretched condition around the ferrule of the brush. The elastic band is rollable onto itself to form a band of increased thickness to serve as a drip guard. The brush can be suspended on the edge of a storage bag and unrollable downwardly over the upper edge of the foil bag to secure the bristles of the brush in the bag and seal the contents of the bag therein.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 5 is a top plan view of the bag, showing the position of the pleats and the fastening means;

FIG. 6 is a top plan view of the bag of FIG. 5, showing the bag in its closed position;

FIG. 8 is an enlarged, fragmentary view of the roll created by rolling the elastic band onto itself.

DESCRIPTION OF THE PREFERRED EMBODIMENT AND BEST MODE

Figure 1:
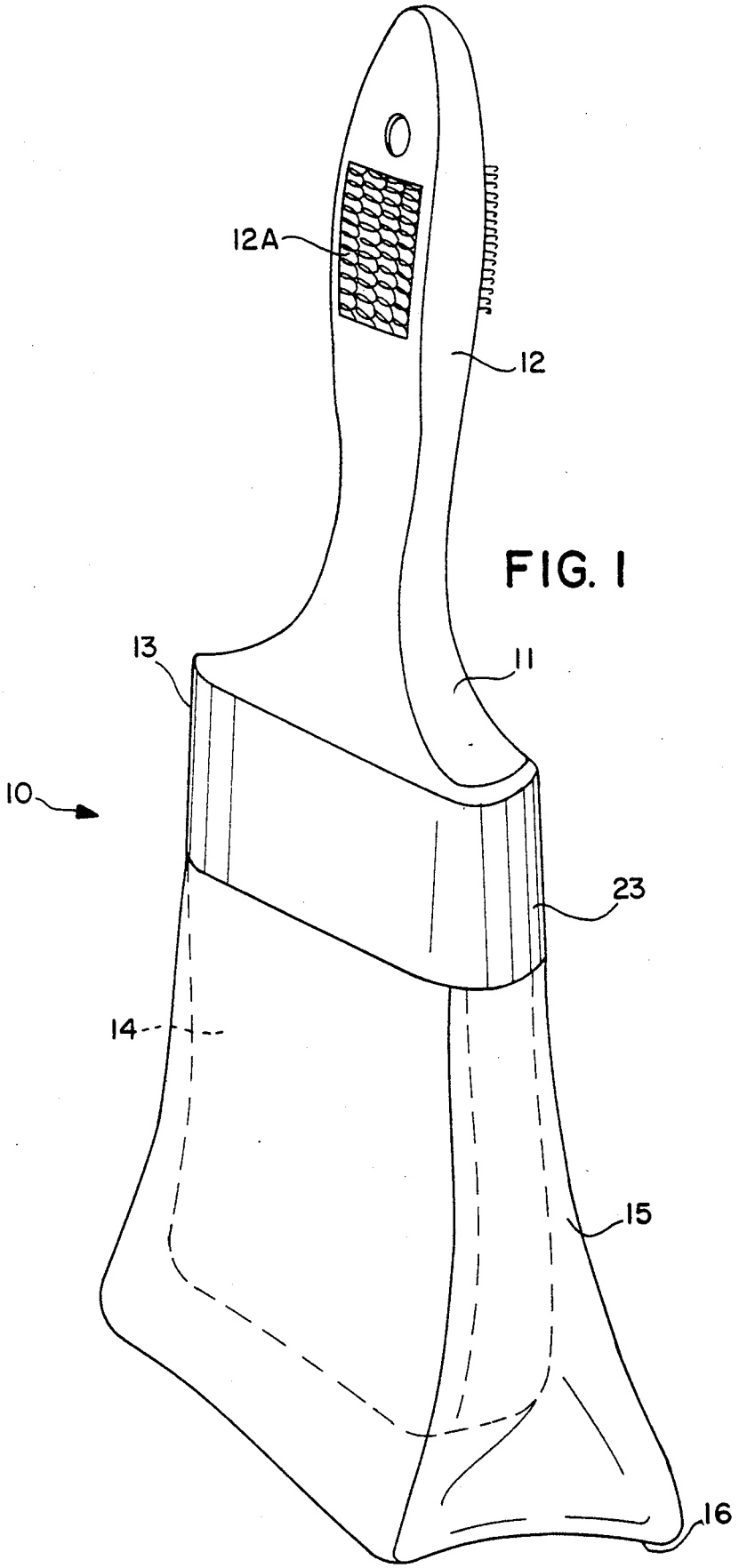
FIG. 1 is a perspective view of an embodiment of the invention.

Referring now specifically to the drawings, a paint brush storage assembly for storing a paint brush according to the present invention is illustrated in FIG. 1 and shown generally at reference numeral 10. The assembly 10 includes a brush 11 with a handle 12, and a ferrule 13 which secures bristles 14 to the handle 12. Either hook or loop fastening members 12A are fastened to one or both sides of handle 12 and permit the brush 11 to be suspended from a supporting surface where complementary fastening members are mounted. The brush 11 is positioned in a heavy foil bag 15 which is pleated and tapered to provide a relatively large base 16. The weight of the liquid in the bag 15 provides ballast to prevent tipping. However, a weight 17 could be used to provide further ballast to the bag 15, if desired. The bag 15 tapers upwardly to a narrower mouth 18 defined by a top edge 19. The foil from which the bag 15 is constructed is similar to that in which vacuum-packed coffee is sold.

Bag 15 is somewhat deeper than the combined length of the bristles 14 and the ferrule 13 so that when the brush 11 is properly secured in the bag 15, the bristles 14 are not resting on the bottom of the bag.

Figure 2:
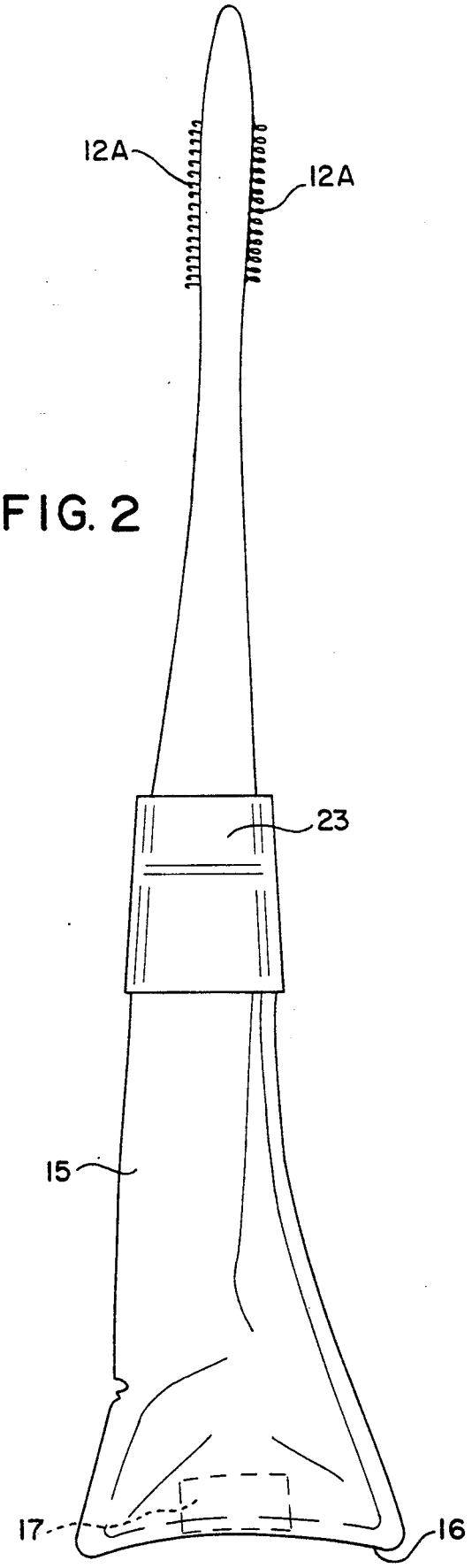
FIG. 2 is a side elevation of the embodiment in FIG. 1.
Figure 4:
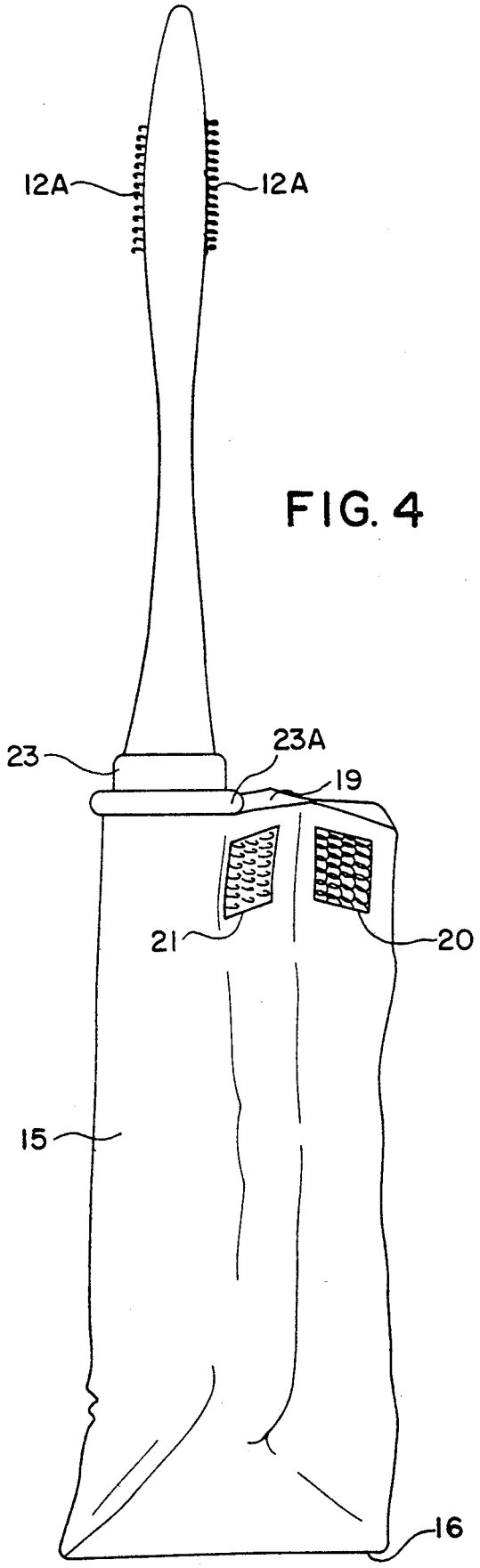
FIG. 4 is a side elevation of the view in FIG. 3, showing the bag in its opened configuration.

As is best shown in FIGS. 4 and 5, the pleats of the bag 15 are secured together by complementary hook and loop fastener members 20 and 21, respectively. As is shown in FIGS. 2 and 6, when the hook and loop fastener members 21 and 20 are touched together, the pleats are secured to the other segment of the bag 15.

The bristles 14 of the brush 11 are sealed into the bag 15 by a large, wide elastic band 23, such as one formed of rubber. The band 20 is secured onto the brush 11 around the ferrule 13 in a tensioned condition, as is shown in FIGS. 1 and 2. The band 20, when rolled down over and overlapping the top edge 19 of the bag 15, tightly seals the sides of the bag 15 under the band 20 against the ferrule 13 and prevents spillage and evaporation of the storage liquid in the bag 15.

Figure 3:
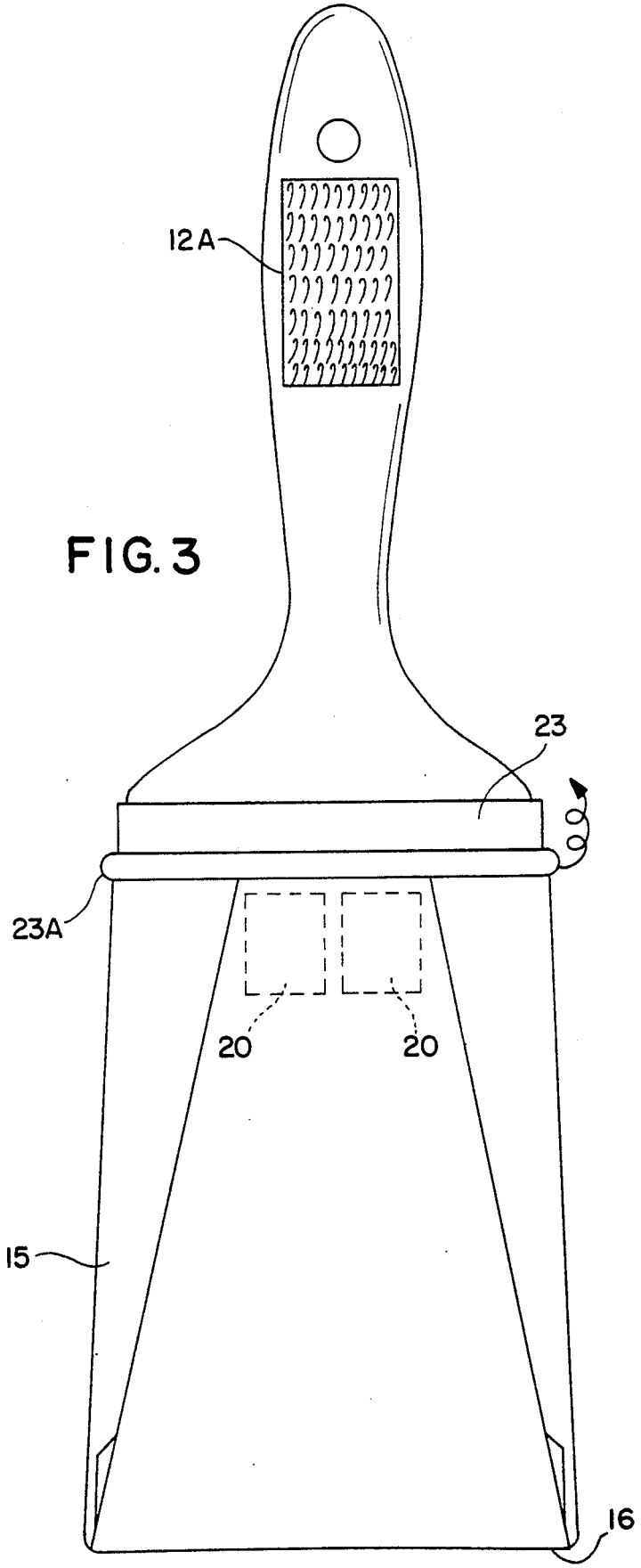
FIG. 3 is a rear elevation of the embodiment of FIG. 1, showing the elastic band rolled into its drip guard position.

To remove the brush 11 from the bag 15, the elastic band 23 is rolled upwardly away from the top edge 19 of the bag 15 onto itself. As is shown in FIGS. 3 and 4, this creates a roll 23A of increased thickness, and permits removal of the brush 11 from the bag 15. As is shown in FIG. 8, the roll 23A will catch drips or runs of paint which run down the handle 12 of the brush 11 when the bristles 14 of the brush 11 are elevated over the handle 12.

Figure 7:
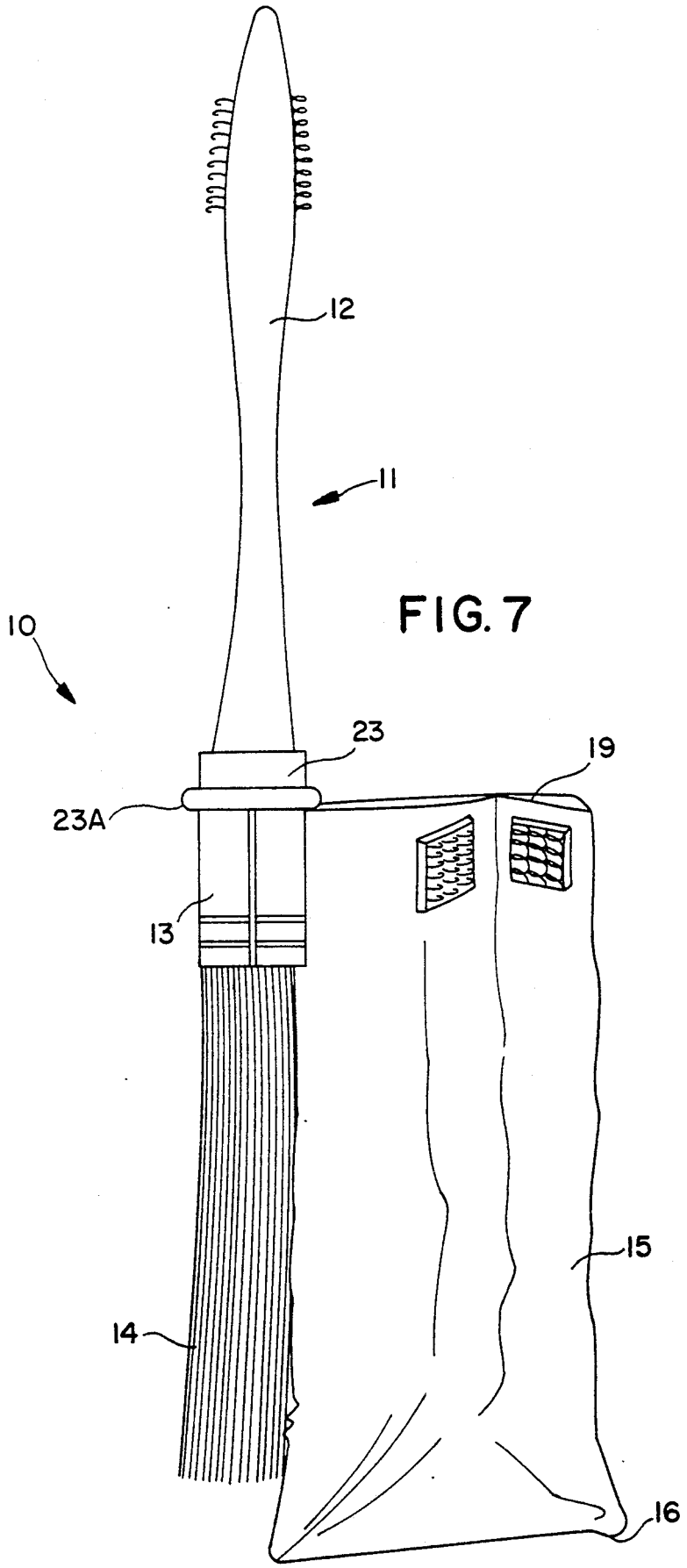
FIG. 7 is a side elevation view showing the brush suspended by the drip guard on the top edge of the bag.

Roll 23A also permits the brush 11 to be suspended from the top edge 19 of the bag 15, as is shown in FIG. 7. The edge 19 of the bag 15 "catches" the roll 23A and supports the brush 11 as shown. The slight taper of the bag 15 from top to bottom, as described above, permits the weight of the brush 15 to lean against the front side of the bag 15.

When the brush 11 has been properly secured into the bag 15, the entire assembly can be hung or otherwise suspended from a supporting surface. The seal created by the elastic band 23 is sufficiently tight, and the foil sufficiently moisture proof, so that a storage liquid in the bag will remain indefinitely without evaporation.

I claim:

1. A paint brush storage bag assembly for storing a paint brush in a storage liquid between uses and holding the brush while in use, comprising:

(a) a bag for receiving the bristles and the adjacent portion of the ferrule therein, the bag having a relatively flat bottom for supporting itself in an upright position and also having a pair of vertical pleats therein for permitting an upper edge of the bag to be closed around the ferrule of the brush;

(b) a paint brush;

(c) a relatively wide elastic band positioned in a stretched condition around the ferrule of the brush;

(d) the elastic band being rollable onto itself to form a band of increased thickness to serve as a drip guard, and whereby the brush can be suspended on the edge of the bag; and (e) said elastic band extending downwardly over the upper edge of the bag to secure the bristles of the brush in the bag and seal the contents of the bag therein.

2. A paint brush storage bag assembly according to claim 1, and including fastening means for securing the pleats of the bag together around the ferrule of the brush.

3. A paint brush storage bag assembly according to claim 2, wherein said fastening means comprises first and second complementary hook and loop fastener members secured in mating relation on opposite sides of said pleat.

4. A paint brush storage bag assembly according to claim 1, wherein said elastic band comprises rubber.

5. A paint brush storage bag assembly according to claim 1, wherein said elastic band is substantially the same width as the ferrule of the brush.

6. A paint brush storage bag assembly according to claim 1, and including a weight in the bottom of the bag to retard the bag from tipping.

7. A paint brush storage bag assembly according to claim 1, wherein the bag defines a front side, said front side being sloped to provide a surface for the brush to lean against when suspended by the rolled up elastic band on the top edge of the bag.

8. A paint brush storage bag assembly according to claim 1, and including hanging means secured to the handle of the brush for hanging the brush for storage.

9. A paint brush storage bag assembly according to claim 8, wherein said hanging means comprises one or the other of a hook and loop member for cooperating with a complementary hook and loop fastener member attached to a supporting surface on which the brush is to be stored.

* * * * *